United States Patent [19]

Okabe et al.

[11] 3,986,941

[45] Oct. 19, 1976

[54] PROCESS FOR THE PRODUCTION OF ALKALI PERMANGANATE

[75] Inventors: Taijiro Okabe, Sendai; Eiichi Narita, Aomori; Yoshiharu Kobayashi, Funabashi; Muneo Mita, Sendai, all of Japan

[73] Assignee: Nippon Chemical Industrial Co., Ltd., Tokyo, Japan

[22] Filed: Mar. 31, 1975

[21] Appl. No.: 563,897

[30] Foreign Application Priority Data

July 12, 1974 Japan ..... 49-79243

[52] U.S. Cl. ..... 204/82

[51] Int. Cl.[2] ..... C25B 1/28

[58] Field of Search ..... 204/82

[56] References Cited

UNITED STATES PATENTS

| | | | |
|---|---|---|---|
| 1,281,085 | 10/1918 | Shoeld | 204/82 |
| 3,172,830 | 3/1965 | Carlis | 204/82 |

*Primary Examiner*—T. Tung

*Attorney, Agent, or Firm*—Sughrue, Rothwell, Mion, Zinn and Macpeak

[57] ABSTRACT

A high-pure alkali permanganate is produced at a high yield by electrolytically oxidizing at a temperature of higher than 60° C a caustic alkali slurry of manganese dioxide and/or an alkali penta-valent manganate having a caustic alkali concentration of 10 to 25% by weight.

11 Claims, 5 Drawing Figures

PROCESS FOR THE PRODUCTION OF ALKALI PERMANGANATE

BACKGROUND OF THE INVENTION

1. FIELD OF THE INVENTION

The present invention relates to a process of producing an alkali permanganate. More particularly, the invention relates to a process of producing a high-pure alkali permanganate at a high yield on an industrial scale without need of complicated operation by preparing a slurry of a tetra-valent manganese oxide and/or an alkali penta-valent manganate having a total caustic alkali concentration of 10 to 25% by weight and subjecting the slurry to an electrolytic oxidation.

2. DESCRIPTION OF THE PRIOR ART

As a conventional typical process of producing an alkali permanganate on an industrial scale, there is a process in which a manganese (IV) oxide is subjected to an oxidation roasting together with a caustic alkali to form an alkali manganate (VI) and after leaching with water, the alkali manganate is electrolytically oxidized.

However, the process encounters various difficulties in many points such as the cost of equipment, the power required, and the labor since, in the process, indirect heating is required for controlling the rate of $CO_2$ gas absorption by the caustic alkali which makes the apparatus complicated, and also the raw materials stick to the inside of the roasting furnace, which reduces the conversion but also the operation efficiency. Furthermore, the aforesaid process is operable only when the caustic alkali employed is caustic potash and since the conversion is reduced greatly when caustic soda is used as the caustic alkali, the process has not been industrially practiced in the latter case.

On the other hand, there is also proposed a process in which the alkali manganate (VI) prepared by fusing manganese (IV) oxide and a caustic alkali together with an oxidizing agent such as an alkali nitrate is converted into an alkali permanganate by an electrolytic oxidation, by an oxidation with an oxidizing agent, or by disproportionation.

However, the aforesaid process wherein the alkali manganate (VI) prepared by fusing manganese oxide and a caustic alkali together with an oxidizing agent encounters the following problem. That is, the first fusion reaction is fundamentally shown by the reaction formula $$MnO_2 + MNO_3 + 2MOH \rightarrow M_2MnO_4 + MNO_2 + H_2O \quad (1)$$

wherein M represents Na or K.

Even if, however, the fusion reaction is carried out for several hours at temperature higher than 500° C, the conversion to the alkali manganate (VI) is low. In the proposed process the alkali manganate (VI) thus-formed is separated usually from the slurry product and is subjected to an electrolytic oxidation to form an alkali permanganate, but since, as descirbed above, the conversion in the first reaction is low, the yield for the alkali permanganate from the manganese oxide is low and thus the process is not practiced for industrial purposes.

Moreover, a process is known in which the slurry of the alkali manganate thus-prepared is oxidized as it is by an oxidizing agent such as chlorine, but in the process it is difficult to regenerate and reuse the excessive alkali used in the process and further the conversion to the alkali permanganate is unsatisfactory.

Furthermore, there is also provided a process in which manganese (IV) oxide in a slurry state is electrolytically oxidized in a heated aqueous caustic alkali solution having a high concentration of about 30 to 40% by weight to form an alkali manganate (VI) as shown in the following reaction formula $$MnO_2 + 2MOH \xrightarrow{\text{electrolytic oxidation}} M_2MnO_4 + H_2 \quad (2)$$

wherein M represents Na or K, the alkali manganate is dissolved in a diluted aqueous caustic alkali solution having a concentration of about 10% by weight in a separate step and subjected to an electrolytic oxidation to form an alkali permanganate as shown by the following reaction formula $$M_2MnO_4 + H_2O \xrightarrow{\text{electrolytic oxidation}} MMnO_4 + MOH + 1/2H_2 \quad (3)$$

wherein M has the same meaning as above.

It is well known that as the process employs an aqueous caustic alkali solution having a high concentration the rate of reaction is high. However, on the other hand, the process has such a fault that as clear from reaction formula (2), the alkali manganate only is formed in the first step and thus the second step shown in reaction formula (3) is necessary for obtaining the alkali permanganate and, in addition, a concentration step of the aqueous caustic alkali solution is required for circulating the MOH by-produced in the step of reaction formula (3) to the step of reaction formula (2). That is, since the process requires complicated steps, such as the two electrolytic oxidation steps, the concentration step, the circulation step, etc., which results in increasing the production cost for the product, the process is disadvantageous for industrial practice.

After all, these processes as described above are confined to a proposition only at present and have various problems in the industrial practice of them since there are many unknown points in the reaction mechanisms of the processes and also the yield for the final aimed product, alkali permanganate is low, which is the fatal fault of these processes.

SUMMARY OF THE INVENTION

Therefore, as a result of various investigations of the fundamental steps for the production of alkali permanganate, such as the electrolytic oxidation of the alkaline slurry of tetra-valent manganese oxide, the conversion to an alkali manganate (V) of the tetra-valent manganese oxide in a manganese ore by the fusion reaction of the manganese ore with a caustic alkali and an alkali nitrate, a leaching step of the alkali manganate (V) by water or an aqueous caustic alkali solution and, the electrolytic oxidation of the alkali manganate, etc., for overcoming the above-mentioned difficulties in the conventional techniques, the inventors have discovered that a high-pure alkali permanganate can be obtained at a high yield by preparing a caustic alkali slurry of tetra-valent manganese oxide and/or an alkali penta-valent manganate having a definite concentration and electrolytically oxidizing the slurry.

That is, according to the present invention there is provided a process of producing an alkali permanganate by electrolytically oxidizing manganese compound which comprises preparing a slurry of tetra-valent manganese oxide and/or an alkali penta-valent manganate having a caustic alkali concentration of 10 to 25% by weight and electrolytically oxidizing the slurry at temperatures higher than 60° C.

BRIEF DESCRIPTION OF THE ACCOMPANYING DRAWINGS

DETAILED DESCRIPTION OF THE INVENTION

Figure 1:
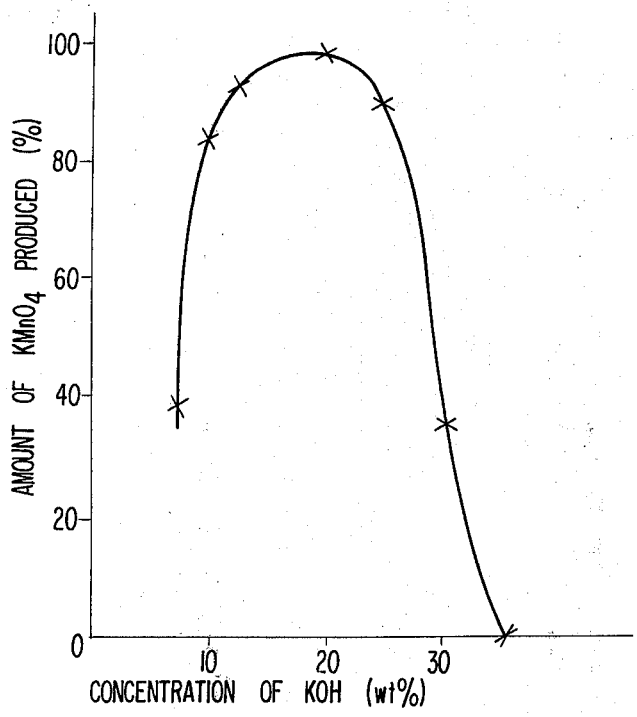
FIG. 1 is a graph showing the relationship between the amount of $KMnO_4$ produced (%) and the concentration of KOH in th electrolysis as described in Example 3.

As the tetra-valent manganese oxide which is used as a raw material in this invention, manganese dioxide as a commercial or industrial product can effectively be used. Other typical examples of the raw material used in this invention are manganese dioxide by-produced in th case of using an alkali permanganate as an oxidizing agent, e.g., manganese dioxide by-produced in the case of removing nitrogen oxides such as NO, $NO_2$, etc., in the gaseous mixtures exhausted from internal combustion engines, factories, power plants, buildings, etc. by absorbing them with a permanganate such as an alkali permanganate and manganese dioxide by-produced in the case of using a permanganate in the oxidation reacton for an organic synthesis such as the production of saccharin.

On the other hand, as the alkali penta-valent manganate whiich is used as another raw material in this invention, there is a material produced by fusing the aforesaid tetra-valent manganese oxide or a natural ore such as pyrolusite together with a caustic alkali and an alkali nitrate at a fusion temperature of higher than 220° C in a mixing ratio that the proportions of MOH and $MNO_3$ are higher than 4 moles and 0.5 mole respectively per mole of $MnO_2$, wherein M represents Na or K.

Thus, the process of this invention is generally classified into two embodiments according to the kind of the raw material to be employed. That is, the first embodiment of this invention stands for the case of using a tetra-valent manganese oxide as the raw material and in this embodiment a slurry of the tetra-valent manganese oxide having a caustic alkali concentration of 10 to 25% by weight is electrolytically oxidized at temperatures higher than 60° C. The second embodiment of this invention stands for the case of using the alkali penta-valent manganate as the raw material. In other words, the typical second embodiment is the case of using the alkali penta-valent manganate obtained by fusing a manganese ore together with a caustic alkali and an alkali nitrate at a definite mixing ratio. That is, in the second embodiment of this invention the slurry of the alkali penta-valent manganate having a total caustic alkali concentration of 10 to 25% by weight is electrolytically oxidized at a temperature of higher than 60° C.

The first embodiment or the second embodiment is suitably selected according to the kind of the manganese compound to be employed as the raw material but, typically speaking, in the first embodiment of this invention the manganese compound used as the raw material is by-produced manganese dioxide, while in the second embodiment the manganese compound used as the raw material is a manganese ore. Now, the both embodiments will be explained separately below in detail.

In the first embodiment, the caustic alkali corresponding to the alkali permanganate which is the aimed product of this invention is used. For example, caustic potash is used in the case of producing potassium permanganate, while caustic soda is used in the case of producing sodium permanganate. In each case it is an important factor to prepare the slurry of the caustic alkali having a concentration range of 10 to 25% by weight, preferably 15 to 25% by weight. The reason is that, as clear from the graph shown in FIG. 1 of the accompaying drawings showing the relation between the concentration of the caustic potash and the yield for potassium permanganate at the electrolysis, the reaction rate for the conversion of the tetra-valent manganese oxide to the (per)manganate is insufficient if the concentration of the caustic alkali is lower than 10% by weight, while the reaction shown by reaction formula (2) only proceeds to form no alkali permanganate if the concentration is higher than about 30% by weight.

Now, the aforesaid tetra-valent manganese oxide is electrolytically oxidized in the slurry of the caustic alkali mentioned above and in this case the electrolysis is carried out using, for example, a pure nickel metal plate as an anode and an iron plate as a cathod by applying a direct current having an anodic current density of 50 to 500 amps/$m^2$ and a current concentration of 3 to 30 amps/liter. The electrolytic conditions may, however, be suitably selected according to the capacity of the reaction, the kinds and amounts of the tetra-valent manganese oxide and the caustic alkali, the state of the slurry, the electrolytic temperature, the nature of the alkali permanganate as the aimed product, etc. For example, a stainless steel plate, an iron plate, a Monel metal plate, etc., may be used as the anode in place of the pure nickel plate.

Figure 2:
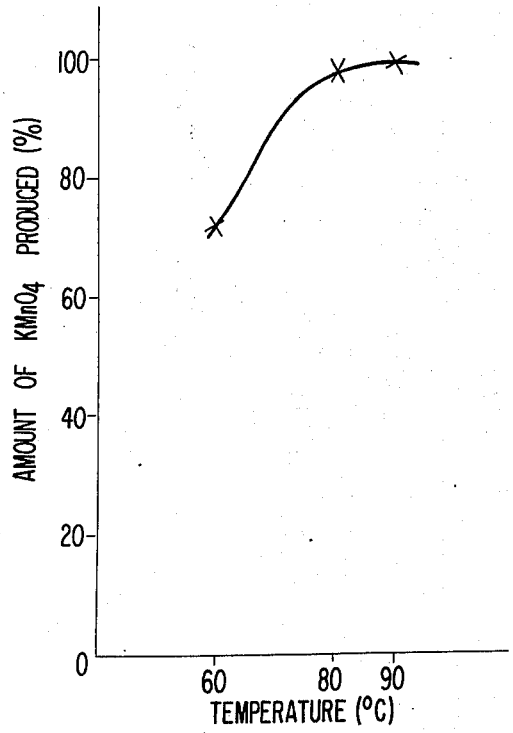
FIG. 2 is a graph showing the relationship between the amount of $KMnO_4$ produced (%) and the temperature used for the electrolysis as described in Example 6.

In order to avoid the decrease in the rate of reaction and to carry out the operation easily, it is preferred that the temperature employed for carrying out the electrolytic oxidation is higher than 60° C, preferably about 80° to 90° C, as clear from the graph shown in FIG. 2 of the accompanying drawings showing the relationship between the temperature at the electrolysis and the yield for potassium permanganate. The upper limit of the electrolytic temperature is restricted by the boiling point of the electrolyte. The electrolytic operation may be carried out under pressure or under a reduced pressure.

In the first embodiment of this invention the alkali permanganate is considered to be produced according to the reaction formula $$MnO_2 + MOH + H_2O \xrightarrow{\text{electrolytic oxidation}} MMnO_4 + 3/2H_2 \quad (4)$$

wherein M represents Na or K.

That is, without staying in the state of the alkali manganate (VI) as shown in reaction formula (2), the tetravalent manganese oxide is almost completely converted into the alkali permanganate in the final state. It is astonishing and unexpected that when the tetra-valent manganese oxide is electrolytically oxidized in a caustic alkali slurry having a concentration of 10 to 25% by weight at a temperature of higher than 60° C, the manganese oxide is directly oxidized into the alkali permanganate.

At the practice of the electrolytic oxidation, the current efficiency at the beginning of the electrolysis can be improved by adding to the electrolyte a catalytic amount of an oxidizing agent such as an alkali permanganate, an alkali ferricyanate, and an alkali perchlorate. The amount of the oxidizing agent is about 0.01 to 0.1 mole, preferably 0.02 to 0.1 mole per mole of manganese dioxide.

The first embodiment of the present invention is then illustrated by the following example. That is, a tetravalent manganese oxide and a caustic alkali are placed in a reaction vessel equipped with a stirrer and a thermometer, water is added to the mixture so that the concentration of the caustic alkali becomes 10 to 25% by weight to form an electrolyte, the electrolyte is maintained at temperatures above 60° c, and after immersing therein a cylindrical nickel plate as the anode and an iron rod as th cathode with stirring, a direct current of a definite current density is passed through the electrodes for a definite period of time to carry out the electrolysis. After the electrolysis is over, the reaciton mixture is analyzed about insoluble magnanese dioxide, the alkali manganate, and the alkali permanganate contained therein according to ordinary manners and the conversion ratio of manganese dioxide and the formation ratio of tth alkali permanganate are calculated by the following formulae:

$$\text{Conversion Ratio (\%) of } MnO_2 = \frac{A - B}{A} \times 100$$

$$\text{Formation Ratio (\%) of } MMnO_4 = \frac{C}{A} \times 100$$

A: Amount of $MnO_2$ used as the raw material.

B: Amount of insoluble $MnO_2$ in the solution after electrolysis.

C: Amount of $MMnO_4$ formed in the solution after electrolysis.

Then, the second embodiment of this invention will be explained in detail. That is, the process of producing an alkali permanganate by the second embodiment comprises a first step in which a mixture of manganese oxide, a caustic alkali, and an alkali nitrate is fused at a temperature of higher than 220° C at the mixing ratio that the proportions of MOH and $MNO_3$ are higher than 4 moles and 0.5 mole, respectively per 1 mole of $MnO_2$, in which M represents Na or K, to convert the manganese oxide to an alkali manganate (V), a second step in which the fusion product obtained in the first step is mixed with water to provide a slurry having a total caustic alkali concentration of 10 to 25% by weight, and a third step in which the slurry obtained in the second step is subjected an electrolytic oxidation in situ.

Now, as the manganese oxide used as the raw material in the aforesaid process, a natural ore such as pyrolusite is used as a matter of course but manganese dioxide by-produced in the case of using an alkali permanganate as an oxidizing agent is also used as a typical example thereof although the raw material used in this invention is not limited to the above materials.

The caustic alkali used in this case may be caustic soda or caustic potash and the material may be used as a solid state or a solution state. Furthermore, examples of the alkali nitrate are sodium nitrate and potassium nitrate and the nitrate may be used as a solid state or a solution state as in the above case. Still further, the alkali nitrate may be a mixture of a caustic alkali and nitric acid.

When these starting materials are mixed and fused by heating, manganese dioxide is oxidized by the alkali nitrate according to the main reaction shown by the following reaction formula to form an alkali manganate (V):

$$2MnO_2 + 6MOH + MNO_3 \rightarrow 2M_3MnO_4 + MNO_2 + 3H_2O \quad (5)$$

wherein M represents Na or K.

Figure 3:
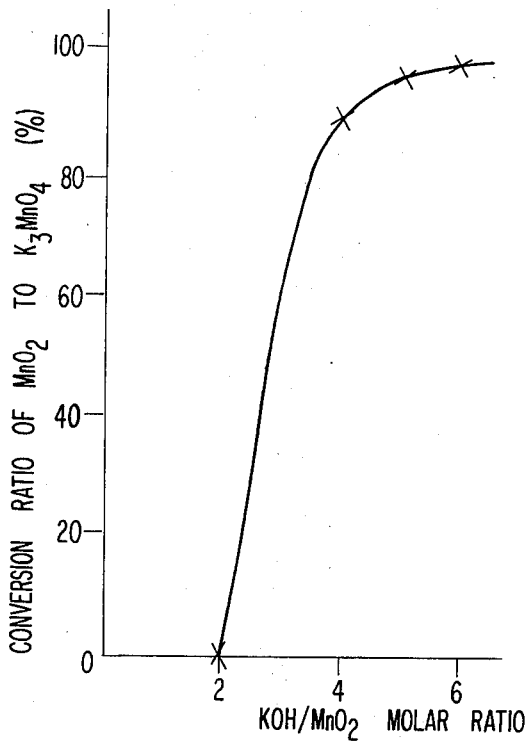
FIG. 3 is a graph showing the relationship between the conversion ratio (%) of $MnO_2$ to $K_3MnO_4$ and the molar ratio of $KOH/MnO_2$ in the manganese ore in the second embodiment as described in Example 7.
Figure 4:
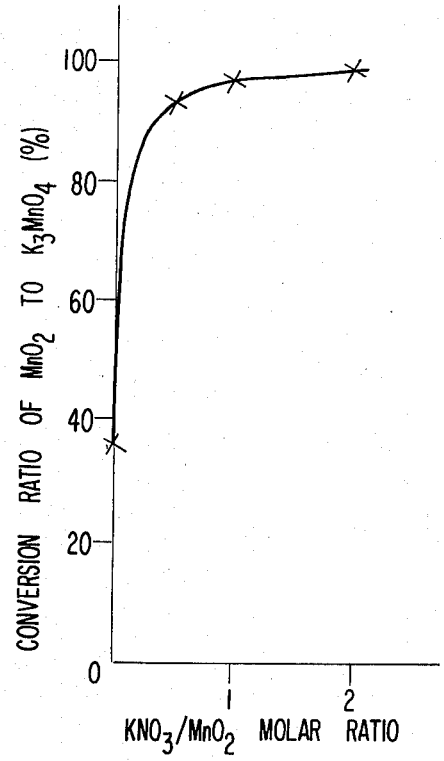
FIG. 4 is a graph showing the relationship between the conversion ratio (%) of $MnO_2$ to $K_3MnO_4$ and the molar ratio of $KNO_3/MnO_2$ in the manganese ore in the second embodiment as described in Example 7.

In this case it is necessary to mix the starting materials so that the proportions of the caustic alkali (MOH) and the alkali nitrate ($MNO_3$) are higher than about 4 moles and about 0.5 mole respectively per 1 mole of $MnO_2$ in the manganese oxide. The reason is that as clear from the graph shown in FIG. 3 of the accompanying drawings showing the relation between the mole ratio of manganese dioxide in the manganese ore to the caustic potash and the conversion of manganese dioxide in the manganese ore to the potassium penta-valent manganate, when the proportion of MOH is lower than 4 moles per mole of $MnO_2$, the conversion to the alkali manganate (V) is greatly reduced as well as the occurrence of the aforesaid reaction of reaction formula (1) showing a poor conversion is expected and further the occurrence of a homogeneous reaction in the fused materials having a high fluidity can not be expected. On the other hand, the alkali nitrate acts effectively as a flux and when the alkali nitrate is not added, the oxidation becomes insufficient as well as manganese dioxide tends to expand greatly to form a paste. Accordingly, it is required that the proportion of $MNO_3$ be at least 0.5 mole per mole of $MnO_2$ as shown in the graph of FIG. 4 showing the relation of the mole ratio of manganese dioxide in the manganese ore to potassium nitrate and the conversion of manganese dioxide in the manganese ore to potassium manganate (V).

In the composition ratio of the starting materials, the upper limit of the caustic alkali or the alkali nitrate may be properly selected at practice and in many cases sufficient result is obtained when the proportion of the former is 4 to 10 moles and the proportion of the latter is about 0.5 to 4 moles per mole of $MnO_2$.

Figure 5:
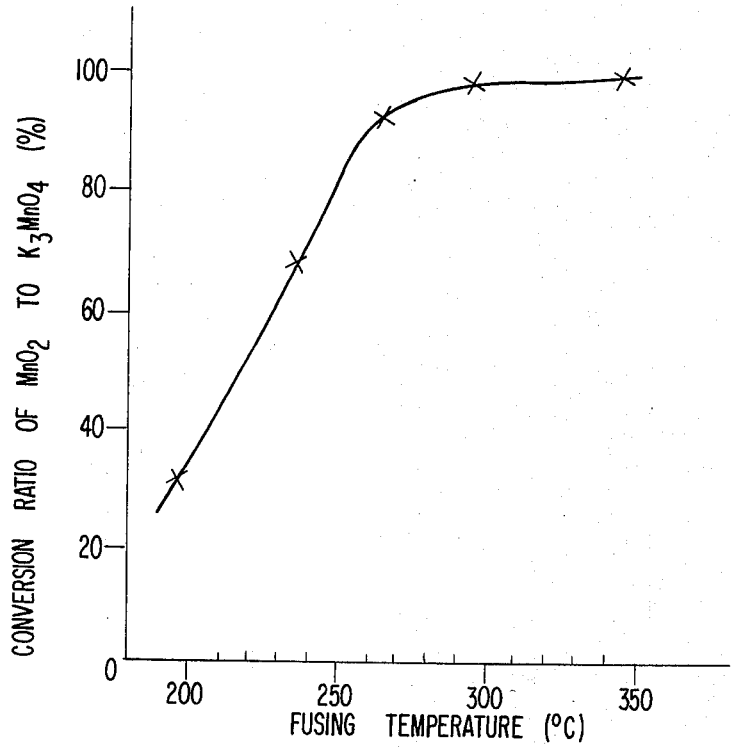
FIG. 5 is a graph showing the relationship between the conversion ratio (%) of $MnO_2$ to $K_3MnO_4$ and the fusing temperature used in the second embodiment as described in Example 7.

Then, when the mixture having the aforesiad composition is heated, the mixture begins to fuse, the reaction of formula (5) occurs at temperatures higher than about 220° C to increase the conversion of the alkali manganate (V), and the reaction is greatly promoted at temperatures higher than about 300° C as shown in the graph of FIG. 5 showing the relation between the fusion temperature and the conversion to the alkali penta-valent manganate. Therefore, the mixture of the starting materials may be heated to a temperature higher than 220° C in the fusion reaction and the upper limit of the fusion temperature may be about 500° C on considering the practical aspect. Furthermore, the mixture may be fused within a period of 3 hours after the temperature of the system reached the aforesaid temperature.

Thus, in the first step of the second embodiment of this invention, the homogeneous fused mixture having a high fluidity is obtained and thus the alkali manganate (V) can be produced at a high yield by fusing and oxidizing the manganese oxide in the quite easy operation.

Then, by mixing the fused product thus-obtained with water in an ordinary manner, the alkli manganate (V) is dissolved to provide a desired slurry. In this case the alkali manganate (V) partially causes the disproportionation reaction as shown in the following formula by hydrolysis to form an insoluble manganese (IV) oxide.

$$2M_3MnO_4 + 2H_2O \rightarrow M_2MnO_4 + MnO_2 + 4MOH \qquad (6)$$

wherein M represents Na or K.

Also, a part of the alkali manganate (VI) undergoes the following reaction:

$$3M_2MnO_4 + 2H_2O \rightarrow 2MMnO_4 + MnO_2 + 4MOH \qquad (7)$$

wherein M represents Na or K, and, therefore, the slurry by leaching is an alkaline slurry containing soluble manganates such as an alkali penta-valent manganate, an alkali hexa-valent manganate, and alkali permanganate, etc., and insoluble manganese oxides. In the leaching process the fused product is usually leached with water but it is also preferable to carry out the leaching operation with an aqueous caustic alkali solution. When the concentration of caustic alkali increases at leaching, the occurrence of the disproportionation reaction of the aforesaid reaction formula (6) is restrained and at the same time the dissolution rate of the soluble alkali manganate (VI) is increased. Therefore, the excessive amount of the alkali in the fusing step acts effectively in the subsequent step as well as can be repeatedly used without necessity of using an aqueous caustic alkali solution in the leaching step and thus the amount of the alkali in the fusion step is not limited and may be selected suitably from the practical aspect as mentioned above.

It is required as the inevitable electrolytic oxidation condition in the third step that the slurry thus-obtained has a total caustic alkali concentration of about 10 to 25% by weight, in particular, 15 to 25% by weight as shown in FIG. 1. In this case, the term "total caustic alkali concentration" means the amount of the caustic alkali used at fusing reaction in terms of the concentration thereof in the electrolysis and, when a caustic alkali is added, as the case may be, at leaching, the total caustic alkali concentration also includes the amount of the caustic alkali added in the leaching.

When such a slurry is electrolytically oxidized, the insoluble manganese oxide is, surprisingly, electrolyzed as shown in the following formula:

$$MnO_2 + MOH + H_2O \xrightarrow{\text{electrolytic oxidation}} MMnO_4 + 3/2H_2 \qquad (4')$$

wherein M represents Na or K.

The reason for limiting the total caustic alkali concentration in the slurry as described above is that the purpose of the electrolytic oxidation is to utilize positively the insoluble manganese oxides formed by the disproportionation but when the total caustic alkli concentration is lower than about 10% by weight, the conversion of the manganese oxides is delayed as in the first embodiment of this invention and thus a sufficiently high reaction ratio can not be obtained. On the other hand, when the concentration is higher than about 25% by weight, the alkali manganate tends to become difficult to be oxidized as shown in the following formula and, in particular, when the concentration is higher than about 30% by weight, the occurrence of the oxidation to the alkali permanganate becomes substantially difficult as shown in the following formula:

$$MnO_2 + 2MOH \xrightarrow{\text{electrolytic oxidation}} M_2MnO_4 + H_2 \qquad (2')$$

wherein M represents Na or K.

As described above, in the second embodiment of this invention the slurry is subjected to an electrolytic oxidation as it is or without being separated and in this case the electrolytic condition can be selected as in the first embodiment of this invention described before.

In addition, in the case of the second embodiment of this invention, an oxidizing agent for improving the current efficiency at the beginning of the electrolysis may be optionally added.

Then, after removing residues from the reaction mixture, the alkali permanganate thus-formed is recovered by crystallization. However, since an alkali nitrite formed in the fusion step is oxidized into an alkali nitrate in the electrolytic step, the alkali nitrate transfers to the mother liquor together with an excessive caustic alkali after the crystallization of the alkali permanganate and the mother liquor may be repeatedly used as the raw material in the fusing step after being concentrated. That is, in the present invention, an excessive alkali is not consumed as waste materials to discard as in the conventional process for oxidizing with an oxidizing agent such as chlorine.

As described above, the conventional process requires the two steps of reaction formulae (2) and (3) for producing an alkali permanganate but in the first embodiment of this invention a high-pure alkali permanganate can be produced directly from a tetravalent manganese oxide in one step as shown in the aforesaid reaction formula (4). Also, since a caustic alkali is produced as a by-product in the conventional process as is clear from the aforesaid reaction formula (3), it is necessary in the process to concentrate the diluted aqueous caustic alkali solution having a concentration of about 10% by weight, after separating the alkali permanganate, using an evaporator to form an aqueous caustic alkali solution having a concentration of 30 to 40% by weight and then circulate the resulting concentrated solution to the proceeding step shown by the aforesaid reaction formula (2). However, in the present invention, as will be understood from the reaction formula (4), a caustic alkali is not produced as a by-product and thus the complicated operations as the concentration, circulation, etc., are not necessary. Thus, in the present invention, the cost required for concentrating the diluted aqueous caustic alkali solution as in the conventional process is not necessary, thereby greatly reducing equipment costs, power costs, and labor costs.

Also, an alkali permanganate is frequently used in various organic syntheses as an oxidizing agent in oxidation reactions and in this case manganese dioxide is produced as a by-product, which is merely discarded or used in the form of manganese dioxide. On the other hand, in the present invention such manganese dioxide as a by-product can be easily reused at a low cost and can be repeatedly used as an oxidizing agent.

Furthermore, while it has hitherto been proposed to produce an alkali permanganate from a manganese oxide by a fusing step and an electrolytic oxidation step, according to the second embodiment of this invention, a high reactivity to the alkali manganate (V) is secured in the first fusing step and then the insoluble manganese oxides formed inevitably in the second leaching step can also be positively utilized in the third electrolytic step together with the soluble alkali manganate. Also, the electrolytic step of the second embodiment of this invention also has advantages as in the first embodiment of this invention, that is, the electrolytic step can be practiced in one step and the concentration procedure of a caustic alkali solution becomes unnecessary. Thus, in the second embodiment of this invention the whole steps are greatly shortened as compared with conventional processes and hence the second embodiment is also valuable in practicing on an industrial scale.

The present invention will further be illustrated in greater detail by the following examples, but these examples are not to be construed as limiting the invention. Unless otherwise indicated, all percents, parts, ratios, etc., are by weight.

EXAMPLE 1

The raw material containing the various tetra-valent manganese oxides as shown in Table 1 was placed in a one-liter beaker in an amount of 1 mole as $MnO_2$ together with 4.2 moles of potassium hydroxide and then water was added to the mixture to make the total volume 1 liter. In this case the concentration of KOH was about 20% by weight. Then, 0.02 mole of potassium permanganate was added to the resulting system for increasing the current efficiency at the beginning of the electrolysis and after immersing a cylindrical nickel plate and an iron rod in the system as an anode and a cathode respectively, a direct current of 10 amperes was passed through the electrodes for 18 hours while maintaining the temperature of the solution at a temperature of 80° C.

Upon completion of the electrolysis, the product solution was analyzed and the results obtained are shown in Table 2 together with the conversion ratio of $MnO_2$ and the formation ratio of $KMnO_4$ calculated from the results.

TABLE 1

| Raw Material No. | $MnO_2$ (wt. %) | Total K (wt. %) | Total Na (wt. %) |
|---|---|---|---|
| 1 | 68.45 | 12.80 | 7.72 |
| 2 | 81.64 | 10.1 | 2.54 |
| 3 | 69.37 | 7.92 | 12.80 |
| 4 | 68.79 | 19.6 | 0.08 |
| 5 | 68.36 | 21.6 | 0.09 |

TABLE 2

| Raw Material No. | Solution after Electrolysis*[1] Analytical Value | | | | |
|---|---|---|---|---|---|
| | $MnO_2$(mole) | $K_2MnO_4$(mole) | $KMnO_4$(mole) | $MnO_2$*[2] | $KMnO_4$*[3] |
| 1 | 0.120 | 0.080 | 0.820 | 88.0 | 80.0 |
| 2 | 0.006 | 0.085 | 0.929 | 99.4 | 90.9 |
| 3 | 0.018 | 0.014 | 0.988 | 98.2 | 96.8 |
| 4 | 0.029 | 0.137 | 0.854 | 97.1 | 83.4 |
| 5 | 0.019 | 0.106 | 0.895 | 98.1 | 87.5 |

*[1]Electrolysis using 1.0 mole of $MnO_2$, 4.2 moles of KOH (at a concentration of 20% by weight), 0.02 mole of $KMnO_4$ and a direct current of 10 A at a temperature of 80° C for 18 hours.
*[2]Conversion ratio (%).
*[3]Formation ratio (%).

EXAMPLE 2

In a one-liter beaker were placed 1 mole of $MnO_2$ by-produced when nitrogen oxides (hereinafter, they are called $NO_x$) were absorbed in an aqueous $KMnO_4$ solution and 4.2 moles of KOH and then water was added to the mixture to make the total volume 1 liter. In this case the concentration of KOH was about 20% by weight. Then, 0.02 mole of potassium permanganate was added to the resulting system and after immersing therein a cylindrical nickel plate and an iron rod as an anode and a cathode respectively, a direct current of 10 amperes was passed through the electrodes for 18 hours while maintaining the solution at a temperature of 80° C.

Upon completion of the electrolysis, the product solution formed was analyzed and the results obtained are as follows:

$MnO_2$: 0.01 mole
$K_2MnO_4$: 0.01 mole
$KMnO_4$: 1.00 mole

The conversion ratio of $MnO_2$ and the formation ratio of $KMnO_4$ calculated from these results were 99% and 98%, respectively.

EXAMPLE 3

When the same procedure as in Example 2 was repeated using the raw materials as in Example 2 while changing the concentration of KOH variously, the results shown in Table 3 were obtained. The results are also shown by the graph in FIG. 1.

TABLE 3

| Concentration of KOH (wt. %) | 7.5 | 10.0 | 12.5 | 20.0 | 25.0 | 30.0 | 35.0 |
|---|---|---|---|---|---|---|---|
| Formation Ratio of $KMnO_4$ (%) | 38.5 | 85.0 | 92.0 | 98.0 | 89.0 | 34.5 | 0 |

EXAMPLE 4

In a one-liter beaker were placed 0.5 mole of $MnO_2$ produced as a by-product when $NO_x$ was absorbed in an aqueous $KMnO_4$ solution, 8 moles of NaOH, and 0.01 mole of $KMnO_4$ and then water was added to the system to make the total volume 1 liter. In this case the concentration of NaOH was about 25% by weight. Then, after immersing therein the same electrodes as in Example 2, a direct current of 20 amperes was passed through the electrodes for 4.5 hours while maintaining the solution at a temperature of 90° C.

Upon completion of the electrolysis, the product solution was analyzed and the results obtained are as follows:

$MnO_2$: 0.01 mole
$Na_2MnO_4$: 0.05 mole
$NaMnO_4$: 0.44 mole
$KMnO_4$: 0.01 mole Also, the conversion ratio of $MnO_2$ and the formation ratio of $NaMnO_4$ calculated from the results were 98% and 88%, respectively.

EXAMPLE 5

In a one-liter beaker were placed 0.5 mole of $MnO_2$ by-produced at the production of saccharin and 2.0 moles of KOH and water was added thereto to make the total volume 1 liter. In this case the concentration of KOH was about 10% by weight. Then, 0.1 mole of potassium permanganate was added to the system and after immersing therein the electrodes same as those in Example 2, a direct current of 10 amperes was passed through the electrodes for 9 hours while maintaining the solution at 80° C.

Upon completion of the electrolysis, the product solution was analyzed and the results obtained are as follows:

$MnO_2$: 0.02 mole
$K_2MnO_4$: 0.06 mole
$KMnO_4$: 0.52 mole

The conversion ratio of $MnO_2$ and the formation ratio of $KMnO_4$ calculated from the above results were 96% and 84%, respectively.

EXAMPLE 6

In a one-liter beaker were placed 0.5 mole of $MnO_2$ by-produced when potassium permanganate was used as an oxidizing agent in an organic synthesis, 4.2 moles of KOH, and 0.1 mole of $KMnO_4$ and water was added thereto to make the total volume 1 liter. In this case the concentration of KOH was about 20% by weight. Then, after immersing therein the electrodes same as those in Example 2, a direct current of 10 amperes was passed through the electrodes for 9 hours while maintaining the solution at 60° C.

Upon completion of the electrolysis, the product solution was analyzed and the results obtained are as follows:

$MnO_2$: 0.109 mole
$K_2MnO_4$: 0.035 mole
$KMnO_4$: 0.456 mole

The conversion ratio of $MnO_2$ and the formation ratio of $KMnO_4$ calculated from the results were 78.2% and 71.2%, respectively.

Also, when the same procedure as above was repeated except that the solution was maintained at 80° C or 90° C at the electrolysis, the formation ratio of $KMnO_4$ was 98.0% when the solution was maintained at 80° C and was 99.0% at 90° C. These results are shown by the graph in FIG. 2.

EXAMPLE 7

The results of various investigations of the fusing conditions for pyrolusite are shown below:

1. To the mixture of a powder of pyrolusite ($MnO_2$ 77% by weight) crushed to about 200 mesh in a fixed amount of 0.5 mole as $MnO_2$ and the crystal of potassium nitrate in a fixed amount of 0.5 mole as $KNO_3$ was added solid caustic potash (KOH 83% by weight) while changing variously the amount of caustic potash in a range of 2 to 6 as the mole ratio of $KOH/MnO_2$ to $MnO_2$ in the aforesaid ore, and the resultant mixtures each was fused in an SUS 27 reaction vessel at 300° C for 2 hours with stirring. In this case, the conversion ratio (%) of manganese dioxide in the ore to $K_3MnO_4$ was measured and the results obtained are shown in Table 4. The results are also shown by the graph in FIG. 3.

TABLE 4

| $KOH/MnO_2$ Mole Ratio | 2 | 4 | 5 | 6 |
|---|---|---|---|---|
| Conversion Ratio (%) to $K_3MnO_4$ | 0 | 90.0% | 97.0% | 99.0% |

2. To the mixture of a powder of pyrolusite ($MnO_2$ 77% by weight) crushed to about 200 mesh in a fixed amount of 0.5 mole as $MnO_2$ and solid caustic potash (KOH 83% by weight) in a fixed amount of 2.5 moles as KOH was added the crystal of potassium nitrate as $KNO_3$ while changing the amount of potassium nitrate in a range of 0 to 2 as the $KNO_3/MnO_2$ mole ratio to $MnO_2$ in the ore and each of the resultant mixtures was fused in an SUS 27 reaction vessel at 300° C for 2 hours with stirring. In this case, the conversion (%) of manganese dioxide in the ore to $K_3MnO_4$ was measured and the results are shown in Table 5. The results are also shown by the graph in FIG. 4.

TABLE 5

| $KNO_3/MnO_2$ Mole Ratio | 0 | 0.5 | 1 | 2 |
|---|---|---|---|---|
| Conversion to $K_3MnO_4$ | 36.5% | 94.0% | 97.5% | 99.0% |

3. A mixture of a powder of pyrolusite ($MnO_2$ 77% by weight) crushed into about 200 mesh in a fixed amount of 0.5 mole as $MnO_2$, solid caustic potash (KOH 83% by weight) in a fixed amount of 2.5 moles as KOH, and the crystal of potassium nitrate in a fixed amount of 0.5 mole as $KNO_3$ was fused in a SUS 27 reaction vessel for 2 hours as a fixed fusing period of time while changing variously the fusing temperature in a range of 200° to 350° C. In this case, the conversion (%) of manganese dioxide in the ore to $K_3MnO_4$ was measured, the results being shown in Table 6. The results are also shown by the graph in FIG. 5.

TABLE 6

| Fusion Temperature (° C) | 200 | 240 | 270 | 300 | 350 |
|---|---|---|---|---|---|

TABLE 6-continued

| | | | | | |
|---|---|---|---|---|---|
| Conversion to $K_3MnO_4$ | 30.0 | 67.0 | 91.5 | 97.0 | 97.5 |

From the experimental results obtained in Experiments (1), (2), and (3), it has been confirmed that in order to fuse pyrolusite for converting effectively $MnO_2$ in the ore to the alkali manganate (V), the proportions of caustic alkali and alkali nitrate used are required to be higher than 4 moles and 0.5 mole per mole of $MnO_2$ in the ore and the mixture is required to be fused at a temperature higher than 220° C. Thus, potassium permanganate was produced from the manganese ore by the following electrolytic experiment.

4. A mixture of the powder of pyrolusite ($MnO_2$ 77% by weight) crushed into about 200 mesh in an amount of 0.5 mole as $MnO_2$, solid caustic potash (KOH 83% by weight) in an amount of 2.5 moles as KOH, and the crystal of potassium nitrate in an amount of 0.5 mole as $KNO_3$ was fused in an SUS 27 reaction vessel at 300° C for 2 hours with stirring. The fused liquid showed good fluidity and the reaction could be carried out uniformly. In this case, the conversion of manganese dioxide in the ore to an alkali manganate ($K_3MnO_4$) reached 97%. Then, the fused product thus-obtained was added to water to make the total volume 1 liter. In this case, the total concentration of KOH in the slurry thus-formed as 12.7% by weight. The slurry was placed in an electrolytic bath equipped with a nickel anode and an iron cathode and then electrolytically oxidized by passing a direct current of 5 amperes for 18 hours at a bath temperature of 80° C and an anodic current density of 100 amps/m². Upon completion of the electrolysis, the product solution was analyzed and the results obtained are as follows:

$MnO_2$: 0.053 mole
$K_2MnO_4$: 0.055 mole
$KMnO_4$: 0.392 mole

The conversion ratio of $MnO_2$ and the formation ratio of $KMnO_4$ calculated from the results were 89.4% and 78.4%, respectively.

EXAMPLE 8

A mixture of the powder of pyrolusite as in Example 7 in an amount of 0.5 mole as $MnO_2$, an aqueous caustic soda solution (NaOH 50%) in an amount of 3.0 moles as NaOH, and the crystal of sodium nitrate in an amount of 1 mole as $NaNO_3$ was placed in an SUS 27 reaction vessel and after increasing gradually the temperature of the mixture with stirring, the reaction of them was carried out at 400° C for 3 hours. In this case, the conversion of manganese dioxide in the ore to sodium manganate (V) was 95%.

The fused product thus-obtained was added to water to make the total volume of the slurry 1 liter. The total concentration of NaOH in the slurry was about 10% by weight. The slurry was electrolytically oxidized as in Example 4 by passing a direct current of 20 amperes for 4.5 hours at an anodic current density of 400 amps/m² while maintaining the slurry at 70° C. Upon completion of the electrolysis, the product was analyzed and the results obtained are as follows:

$MnO_2$: 0.071 mole
$Na_2MnO_4$: 0.071 mole
$NaMnO_4$: 0.358 mole

The conversion ratio of $MnO_2$ and the formation ratio of $NaMnO_4$ calculated from the above results were 85.8% and 71.6%, respectively.

COMPARISON EXAMPLE

A mixture of the powder of pyrolusite ($MnO_2$ 77% by weight) crushed into about 200 mesh in an amount of 0.5 mole as $MnO_2$, solid caustic potash (KOH 83% by weight) in an amount of 2.5 moles as KOH, and the crystal of potassium nitrate in an amount of 0.5 mole as $KNO_3$ was fused in an SUS 27 reaction vessel at 300° C for 2 hours with stirring. The fused product was added to water and further 4.5 moles of KOH was added thereto to make the total volume of the slurry 1 liter. In this case, the total concentration of KOH in the slurry was about 30% by weight.

The slurry thus-prepared was electrolytically oxidized in the same electrolytic bath as in Example 2 by passing a direct current of 10 amperes for 9 hours at 80° C and an anodic current density of 200 amps/m².

Upon completion of the electrolysis, the product was analyzed and the results obtained are as follows:

$MnO_2$: 0.045 mole
$K_2MnO_4$: 0.455 mole
$KMnO_4$: 0 mole

The conversion ratio of $MnO_2$ and the formation ratio of $KMnO_4$ calculated from the above results were 91% and 0, respectively.

While the invention has been described in detail and with reference to specific embodiments thereof, it will be apparent to one skilled in the art that various changes and modifications can be made therein without departing from the spirit and scope thereof.

What is claimed is:

1. A process for producing an alkali permanganate by electrolytically oxidizing a manganese compound, which comprises preparing a slurry from at least one of a tetra-valent manganese oxide and an alkali penta-valent manganate, said slurry having a caustic alkali concentration of 10 to 25% by weight and electrolytically oxidizing the slurry at a temperature of higher than 60° C.

2. The process as claimed in claim 1, wherein said tetra-valent manganese oxide is the tetra-valent manganese oxide formed by the decomposition of an alkali permanganate or an alkali manganate.

3. The process as claimed in claim 2, wherein at least one of an alkali permanganate, an alkali ferricyanide, and an alkali perchlorate is added to said slurry at electrolytic oxidation.

4. The process as claimed in claim 2, wherein said tetra-valent oxide is manganese dioxide produced as a by-product using an alkali permanganate in the oxidation reaction of an organic synthesis.

5. The process as claimed in claim 2, wherein said tetra-valent manganese dioxide is manganese dioxide produced as a by-product in the treatment of nitrogen oxides with an alkali permanganate.

6. The process as claimed in claim 1, wherein said alkali penta-valent manganate is a fused product obtained by fusing a tetra-valent manganese oxide together with an alkali nitrate and a caustic alkali.

7. The process as claimed in claim 6, wherein said fused product is a product obtained by fusing a tetra-valent manganese oxide, a caustic alkali, and an alkali nitrate as starting materials, said caustic alkali being used in a proportion higher than 4 moles per mole of $MnO_2$, said alkali nitrate being used in a proportion higher than 0.5 mole per mole of $MnO_2$ and said fusing is at a temperature of higher than 220° C.

8. The process as claimed in claim 6, wherein said tetra-valent manganese oxide is a manganese ore.

9. The process as claimed in claim 7, wherein said caustic alkali and said alkali nitrate are used in the proportions of from 4 to 6 moles and from 0.5 to 2 moles, respectively, per mole of $MnO_2$ in the tetra-valent manganese oxide and said fusing is at a temperature of 220° to 300° C.

10. The process as claimed in claim 1, wherein said alkali permanganate is potassium permanganate or sodium permanganate.

11. The process as claimed in claim 1, wherein said electrolytic oxidation is at a temperature of about 80° to 90° C.

* * * * *